US006177388B1

(12) United States Patent
Cheung et al.

(10) Patent No.: US 6,177,388 B1
(45) Date of Patent: Jan. 23, 2001

(54) BOTANICAL OILS A BLOOMING AGENTS IN HARD SURFACE CLEANING COMPOSITIONS

(75) Inventors: Tak Wai Cheung, Princeton Junction; Dennis Thomas Smialowicz, Waldwick, both of NJ (US)

(73) Assignee: Reckitt Benckiser Inc., Wayne, NJ (US)

( * ) Notice: Under 35 U.S.C. 154(b), the term of this patent shall be extended for 0 days.

(21) Appl. No.: 09/391,714

(22) Filed: Sep. 8, 1999

Related U.S. Application Data

(63) Continuation-in-part of application No. 09/266,036, filed on Mar. 11, 1999.

(30) Foreign Application Priority Data

Apr. 14, 1998 (GB) ..... 9807657

(51) Int. Cl.[7] ..... C11D 3/50; C11D 3/26; C11D 7/50

(52) U.S. Cl. ..... 510/101; 510/238; 510/239; 510/240; 510/384; 510/433; 510/434; 510/477; 510/503; 134/42

(58) Field of Search ..... 510/101, 238, 510/239, 240, 384, 433, 434, 477, 503; 134/42

(56) References Cited

U.S. PATENT DOCUMENTS 5,728,672 * 3/1998 Richter ..... 510/463
5,939,374 * 8/1999 Richter et al. ..... 510/384
6,030,936 * 2/2000 Lu et al. ..... 510/424
6,066,606 * 5/2000 Lu et al. ..... 510/101
6,075,002 * 6/2000 Cheung et al. ..... 510/384

* cited by examiner

*Primary Examiner*—Mark Kopec
*Assistant Examiner*—Brian P. Mruk
(74) *Attorney, Agent, or Firm*—Fish & Richardson P.C.

(57) ABSTRACT

Aqueous concentrated liquid hard surface cleaning compositions which bloom when added to a larger volume of water which comprises the following constituents:

botanical oil constituent;

at least one botanical oil solubilizing surfactant which is preferably an amine oxide surfactant;

an alkyl diphenyl solvent constituent;

a binary solvent system which includes at least one organic alcohol constituent and at least one glycol solvent constituent;

optionally but desirably a polyoxycarboxylate constituent;

optionally but desirably an effective amount of a chelating agent which includes at least one non-ionized acetate group, most preferably a mono-, di- or tri- alkali or alkaline ethylenediaminetetraacetic acid;

optionally but desirably at least one optional constituent selected from: chelating agents, coloring agents, light stabilizers, fragrances, thickening agents, hydrotropes, pH adjusting agents, pH buffers one or more detersive surfactant constituents particularly non-ionic and amphoteric surfactants, as well as others known the art.

The one or more optional constituents are selected to be present, and are included in amounts which do not undesirably affect the overall blooming characteristics of the present inventive compositions, and further the compositions of the invention do not include pine oil.

20 Claims, No Drawings

BOTANICAL OILS A BLOOMING AGENTS IN HARD SURFACE CLEANING COMPOSITIONS

The present application is a continuation-in-part application of U.S. Ser. No. 09/266,036, filed Mar. 11, 1999.

The present invention relates to blooming type compositions. Blooming is a property exhibited by dilutable compositions such as known cleaning compositions, specifically pine-oil type cleaning compositions which contain a significant amount (generally at least about 5% and more) of pine oil which includes a significant proportion of terpene alcohols. Certain phenolic disinfectant compounds, such as LYSOL disinfectant concentrate (Reckitt & Colman, Inc., Montvale N.J.) also exhibit such a blooming property. Blooming may be characterized as the formation of milky, creamy or cloudy appearance which is manifested when a dilutable composition is added to a larger volume or quantity of water. Blooming is an important characteristic from a consumer standpoint as it provides a visual indicator and impression to the consumer that the concentrated product contains active cleaning and/or disinfecting constituents which are released upon addition of the concentrate to a volume of water. Such is an important visual indicator of apparent efficacy of a concentrated product.

While presently commercially available materials have advantageous features, they are not without their attendant shortcomings as well. For example, the use of pine oil, and its pungent characteristic odor is frequently not desired. A further disadvantage is that the use of significant amounts of pine oil in a composition is desirably avoided as the pine oil is know to deposit a sticky residue on hard surfaces, which is particularly undesirable from a consumer standpoint. Also, many such compositions frequently are directed to providing a cleaning effect, and do not provide an appreciable sanitizing effect.

It has now been found that it is now possible to produce certain concentrate compositions utilizing these selected constituents in particular formulations which provide blooming type cleaning compositions in a concentrated liquid form which feature a good blooming effect, and which do not include any significant proportion pine oil, (i.e., less than 0.1% wt., preferably not more than 0.05% wt. and most preferably 0% wt.) but which provide a blooming effect. The "blooming" observed may be described as the change of the water's appearance from essentially colorless and transparent to that of a milky white or milky yellowish white, cloudy appearance. This effect is also sometimes referred to as the "break". Such blooming is a highly desirable in blooming type cleaning compositions as consumer/end user expectations associate cleaning effectiveness with the extent and degree of this blooming upon formation of a cleaning composition. Such blooming is particularly desirable in compositions where the blooming characteristic in an aqueous dilution is long lasting.

Accordingly it is among the objects of the present invention to provide blooming type concentrate compositions wherein the blooming characteristic is based on certain essential oils in conjunction with the specific system of surfactants and organic solvents described in more detail below. It is also among the objects of the invention to provide processes for the production of such provide blooming type concentrate compositions as well as methods of treating hard surfaces using them.

Accordingly in one aspect of the invention there is provided an aqueous concentrated liquid hard surface cleaning composition which blooms when added to a larger volume of water which comprises the following constituents:

botanical oil constituent;

at least one botanical oil solubilizing surfactant, preferably an amine oxide surfactant constituent;

a binary solvent system which includes at least one organic alcohol constituent and at least one glycol solvent constituent;

an alkyl diphenyl solvent;

optionally but frequently desirably, a carboxylate constituent;

optionally but desirably an effective amount of a chelating agent which includes at least one non-ionized acetate group, most preferably a mono-, di- or tri- alkali or alkaline ethylenediaminetetraacetic acid;

optionally but desirably at least one optional constituent selected from: further chelating agents, coloring agents, light stabilizers, fragrances, thickening agents, hydrotropes, pH adjusting agents, pH buffers one or more detersive surfactant constituents particularly non-ionic and amphoteric surfactants, as well as others known the art. The one or more optional constituents are selected to be present, and are included in amounts which do not undesirably affect the overall blooming characteristics of the present inventive compositions;

and the balance of the compositions being water.

In preferred embodiments the concentrate compositions provide excellent initial blooming characteristics in 'as mixed' dilutions with water.

It is a further object of the invention to provide such a concentrated liquid disinfectant composition wherein the composition exhibits a blooming effect when diluted in a larger volume of water.

It is among the further object of the invention to provide such a concentrated liquid disinfectant composition wherein the composition exhibits good long term stability, i.e., shelf stability in its concentrated form.

As an essential constituent in the concentrate compositions according to the present invention there are present one or more botanical oils, sometimes also referred to as "essential oils" which are useful in providing a blooming effect. By way of non-limiting example these include one or more of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobomyl acetate, Isolongifolene, Juniper berry oil, L-methhyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen. Each of these botanical oils is commercially available. As noted previously, the inventive compositions do not include pine oil in any significant amount, although pine oil is known to the prior art to provide blooming effects.

Particularly preferred oils include those which are exemplified by the examples, following, and include: peppermint oil, lavender oil, bergamot oil (Italian), rosemary oil (Tunisian), and sweet orange oil. These may be commercially obtained from a variety of suppliers including: Givadan Roure Corp. (Clifton, N.J.); Berje Inc. (Bloomfield, N.J.); BBA Aroma Chemical Div. of Union Camp Corp. (Wayne, N.J.); Firmenich Inc. (Plainsboro N.J.); Quest International Fragrances Inc. (Mt. Olive Township, N.J.); Robertet Fragrances Inc. (Oakland, N.J.).

These oils may be present in the compositions in any amounts which are effective in providing a desirable blooming effect. Generally amounts from as little as 0.001% wt. to amounts of 20% wt. are useful, based on the total weight of the concentrated liquid disinfectant composition. More preferably these oils are present in amounts of from 0.01–15% wt., still more preferably 0.1–15% wt., and most preferably in amounts of from 1–10% wt. Of course, more a plurality of oils may be used.

A further constituent according to the invention is an organic solvent which is present in addition to the botanical oil which is itself known to be an organic solvent and assists in improves the dispersability and/or miscibility of the botanical oil in water. The organic solvent may also improve the miscibility of further constituents according to the present invention, including any water insoluble or poorly soluble constituents. Many useful organic solvents which are known to be useful in dispersing botanical oil in water may be used; virtually any may be used as long as it does not undesirably disrupt the favorable characteristics of the invention, especially the blooming characteristic. Mixtures of two or more organic solvents may also be used as the organic solvent constituent.

Exemplary useful organic solvents include those which are at least partially water-miscible such as alcohols, water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, dipropylene glycol monobutylether, diethyleneglycol monobutylether), lower esters of monoalkylethers of ethyleneglycol or propylene glycol (e.g. propylene glycol monomethyl ether acetate).

Additionally the inventor has found the according to certain preferred embodiments the organic solvent constituent, comprises, and in certain especially preferred embodiments consist essentially of, an alkylene glycol such as propylene glycol, with a monohydric lower aliphatic alcohol such as a $C_1$–$C_6$ aliphatic primary or $C_1$–$C_6$ aliphatic secondary alcohol, especially isopropyl alcohol, and further a higher aliphatic primary or secondary alcohol such as a $C_8$–$C_{18}$ alcohol, such as cetyl, lauryl and myristyl alcohols but especially lauryl alcohol. Desirably, the alkylene glycol constituent is equal in an amount at least equal to the total amount of both the $C_1$–$C_6$ alcohol and the $C_8$–$C_{14}$ alcohol.

The organic solvent constituent may be present in the concentrated liquid disinfectant compositions in amounts of from about 0.001 % by weight to up to about 50% by weight, preferably about 0.1–40% by weight, most preferably in amount of between 0.1–35% by weight. Of course a mixture of organic solvents may be used.

The concentrate compositions of the invention further comprise at least alkyl diphenyl solvent. The alkyl diphenyl solvent is one which may be generally represented by the formula:

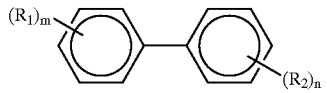

$R_1$ is hydrogen or is a lower alkyl radical, preferably a $C_1$–$C_{10}$, but more preferably is a $C_1$–$C_6$ straight chained or branched alkyl radical, $R_2$ is a lower alkyl radical, preferably a $C_1$–$C_{10}$, but more preferably is a $C_1$–$C_6$ straight chained or branched alkyl radical, m is an integer from 1–3 inclusive; and, n is an integer from 1–3 inclusive.

Preferably $R_1$ has any of the values indicated above, m is 1, and $R_2$ has any of the values indicated above. More preferably, $R_1$ is a $C_1$–$C_6$ straight chained or branched alkyl radical, and m is 1, and $R_2$ is a $C_1$–$C_6$ straight chained or branched alkyl radical. It is to be understood that mixtures of the compounds indicated above may be used as the diphenyl solvent constituent.

Such alkyl diphenyls are, per se, known to the art, and are described in U.S. Pat. No. 3,787,181. Particularly useful as the alkyl diphenyl solvent are materials presently marketed as NUSOLV ABP solvents (ArrisTec Inc., Easton, Pa.) described to be a high purity alkyl diphenyls and mixtures thereof, and are also available from Koch Chemical Co. (Corpus Christi, Tex.).

The alkyl diphenyl solvent may be present in the concentrate compositions in amounts of from about 0.001% by weight to up to about 20% by weight, preferably about 0.01–10% by weight, most preferably in amount of between 0.1–8% by weight.

The inventors have found that with the presence of the alkyl diphenyl solvent in the present formulations, it is preferable to have present in the formulation the higher aliphatic primary or secondary alcohol mentioned herein. Such higher aliphatic primary or secondary alcohols aid in the dissolution of the alkyl diphenyl solvents in the concentrate compositions, ensuring that the clarity of the concentrate formulation is maintained, which is especially important from a consumer standpoint. When used, the higher aliphatic primary or secondary alcohols are present in the concentrate formulations in amounts of from about 0.001% wt. to about 5% wt., preferably from about 0.01% wt. to about 3% wt., and more preferably from about 0.1% wt. to about 2% wt %.

The concentrate compositions of the invention further comprise at least one botanical oil solubilizing surfactant. Particularly useful as the botanical oil solubilizing surfactant are nonionic surfactant compositions based on amine oxides.

Non-limiting examples of useful amine oxide semi-polar nonionic surfactants include those according to the formulae:

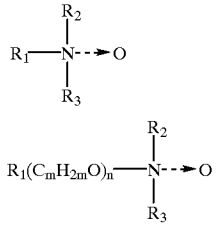

wherein:

$R_1$ is hydrogen or is an alkyl, 2-hydroxyalkyl, 3-hydroxyalkyl, or 3-alkoxy-2-hydroxypropyl radical where the alkyl and alkoxy parts contain from about 8 to about 18 carbon atoms;

$R_2$ and $R_3$ are independently selected from methyl, ethyl, propyl, isopropyl, 2-hydroxyethyl, 2-hydroxypropyl, or 3-hydroxypropyl;

m is an integer from 2 to 4; and n is an integer from 0 to about 10, but is preferably n is at least 1.

Preferably, the amine oxide semi-polar nonionic surfactants are those wherein $R_1$ is an alkyl radical of from 12 to 16 carbon atoms, $R_2$ and $R_3$ are independently selected from methyl or ethyl, m is 2, and n is 0. Specific examples of such useful amine oxide semi-polar nonionic surfactants include cetyl-, myristyl- or lauryl- dimethyl amine oxide or mixtures thereof.

A further useful general class of useful amine oxides which may be included in the amine oxide constituent according to the invention are further alkyl di (lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples include those described above, as well as those in which the alkyl group is a mixture of different amine oxides, dimethyl cocoamine oxides, dimethyl (hydrogenated tallow) amine oxides, and myristyl/palmityl dimethyl amine oxides.

A further class of useful amine oxides include alkyl di (hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide.

Further useful amine oxides include those which may be characterized as alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and Additional useful amine oxides include those which may be referred to as alkylmorpholine oxides in which the alkyl group has about 10–20, and preferably 12–16 carbon atoms, and can be straight or branched chain, saturated or unsaturated.

Useful amine oxides may be obtained from a variety of commercial sources and include for example amine oxides available in the AO series from Tomah Products Inc.; in the AMMONYX series from Stepan Co.; in the BARLOX series (ex. Lonza Inc., Fairlawn, N.J.), in the RHODAMOX series (ex. Rhone-Poulenc Inc, Cranbury, N.J.), as well as in the MACKAMINE series of products (ex. McIntyre Group Ltd.)

Particularly useful amine oxides for use in the present inventive compositions include AO-728 Special which is described to be a composition containing 50% wt. of bis-(2-hydroxyethyl $C_{12}$–$C_{15}$ alkyloxypropyl) amine oxide, bis-(2-hydroxyethyl) isotridecyloxypropylamine oxide, bis-(2-hydroxyethyl) isodecyloxypropylamine oxide (ex. Tomah Products Inc., Milton Wis.), AMMONYX CDO Special described to be cocoamidopropyl dimethyl amine (ex. Stepan Co., Northfield Ill.), as well MACKAMINE AO described to be isostearamidopropylamine oxide, and MACKAMINE CO described to be cocoamine oxide (ex. McIntyre Group Ltd.).

As noted previously, the compositions are aqueous in nature. Water is added in order to provide 100% by weight of the concentrate composition. The water may be tap water, but is preferably distilled and/or deionized water. If the water is tap water, it is preferably appropriately filtered in order to remove any undesirable impurities such as organics or inorganics, especially minerals salts which are present in hard water which may thus interfere with the operation of the other constituents of the invention, as well as any other optional components of the liquid concentrates according to the invention.

Water is added in amounts which are sufficient to form the concentrated compositions which amount is sufficient to ensure the retention of a substantially clear characteristic when produced as a concentrate, but at the same time ensuring good blooming upon the addition of the concentrated composition to a further amount of water, or upon the addition of further water to the concentrate.

Other conventional additives known to the art but not expressly enumerated here may also be included in the compositions according to the invention. By way of non-limiting example without limitation these may include: chelating agents, coloring agents, light stabilizers, fragrances, thickening agents, hydrotropes, pH adjusting agents, pH buffers as well as one or more detersive surfactant constituents including anionic, cationic, non-ionic and amphoteric surfactants. Many of these materials are known to the art, per se, and are described in *McCutcheon 's Detergents and Emulsifiers,* North American Edition, 1998; Kirk-Othmer, *Encyclopedia of Chemical Technology,* 4th Ed., Vol. 23, pp. 478–541 (1997), the contents of which are herein incorporated by reference. Such optional, i.e., non-essential constituents should be selected so to have little or no detrimental effect upon the desirable characteristics of the present invention, namely the blooming behavior, cleaning efficacy, disinfectant activity, and low toxicity as provided by the inventive compositions. Generally the total weight of such further conventional additives may comprise up to 25% by weight of a concentrated composition formulation.

Further optional, but advantageously included constituents are one or more coloring agents which find use in modifying the appearance of the concentrate compositions and enhance their appearance from the perspective of a consumer or other end user. Known coloring agents, may be incorporated in the compositions in effective amount to improve or impart to concentrate compositions a desired appearance. Such a coloring agent or coloring agents may be added in any useful amount in a conventional fashion, i.e., admixing to a concentrate composition or blending with other constituents used to form a concentrate composition. Known art light stabilizer constituents may also be added, particularly wherein coloring agents are used in a composition. As is known to the art, such light stabilizers act to retain the appearance characteristics of the concentrate compositions over longer intervals of time.

Exemplary useful buffers include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Such buffers keep the pH ranges of the compositions of the present invention within acceptable limits.

Exemplary useful pH adjusting agents include known materials which may be used to adjust the pH of the concentrate compositions to a desired range.

Exemplary useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain. Exemplary useful are linear straight chain alkylbenzene sulfonates in which the average number of carbon atoms in the alkyl group is from about 11 to 14.

Other anionic surfactants herein are the water soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water soluble salts of esters of α-sulfonated fatty acids containing from about 0 to 20 carbon atoms in the fatty acid group and from about 1 to 10 carbon atoms in the ester group; water soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Also useful as the anionic surfactant are carboxylates which include alkyl- and alkylaryl-carboxylates which include those which may be represented by the general formula:

$$R—COO^-M^+$$

wherein R is a straight or branched hydrocarbon chain containing from about 9 to 21 carbon atoms, and which may also include an aromatic ring, especially a phenyl group as part of the hydrocarbon chain, and M is a metal or ammonium ion. Further preferred alkylpolyoxycarboxylates include polyethoxycarboxylates which may be represented by the general formula:

$$R—[—OCH_2CH_2—]_n—CH_2COO^-M^+$$

wherein R is a straight chained or branched hydrocarbon chain which may include an aryl moiety, but is desirably a straight chained or branched hydrocarbon chain; and n is an integer value of from 1–24, and M is a metal or ammonium ion, but is preferably a alkali or alkaline earth metal ion, especially sodium.

Exemplary useful alkylpolyoxycarboxylates and alkylarylpolycarboxylates include those commercially available in the NEODOX series from Shell Chemical Co.; SANDOPAN series from Clariant Inc. (Charlotte, N.C.), as well as in the SURFINE series from Finetex, Inc.

When present in the concentrated liquid disinfectant compositions, the alkylpolyoxycarboxylates or alkylarylpolycarboxylate constituent is included in amounts of from about 0.001% by weight to up to about 20% by weight, preferably about 0.1 10% by weight, most preferably in amount of between 1–5% by weight. Of course a mixture of these constituents may be used. It is to be understood that the alkylpolyoxycarboxylates and alkylarylpolycarboxylates may be used in the place or, or in conjunction with the amine oxide constituent discussed herein. Also, mixtures of two or more alkylpolyoxycarboxylates and alkylarylpolycarboxylates may be used.

Exemplary useful optional cationic surfactants include quaternary ammonium compounds and salts thereof include quaternary ammonium germicides which may be characterized by the general structural formula:

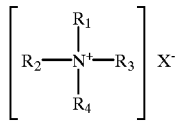

where at least one or $R_1$, $R_2$, $R_3$ and $R_4$ is a alkyl, aryl or alkylaryl substituent of from 6 to 26 carbon atoms, and desirably the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex. Exemplary counterions include halides, for example chloride, bromide or iodide, or methosulfate.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Particularly preferred quaternary ammonium compounds which act as germicides and which are be found useful in the practice of the present invention include those which have the structural formula:

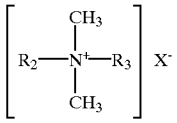

wherein $R_2$ and $R_3$ are the same or different $C_8$–$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or methosulfate. The alkyl groups recited in $R_2$ and $R_3$ may be straight-chained or branched, but are preferably substantially linear. The counterion X is as described previously.

The useful optional nonionic surfactants, include known art nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic surfactant compound. Further, the length of the polyethylenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

To be mentioned as particularly useful nonionic surfactants are alkoxylated linear primary and secondary alcohols such as those commercially available under the tradenames POLYTERGENT SL series (Olin Chemical Co., Stamford Conn.), NEODOL series (Shell Chemical Co., Houston Tex.); as alkoxylated alkyl phenols including those commercially available under the tradename TRITON X series (Union Carbide Chem. Co., Danbury Conn.).

Further exemplary useful nonionic surfactants which may be used include certain alkanolamides including monoethanolamides and diethanolamides, particularly fatty monoalkanolamides and fatty dialkanolamides. Commercially available monoethanol amides and diethanol amides include those marketed under the trade names ALKAMIDE and CYCLOMIDE by Rhodia Inc., (Cranbury, N.J.).

Exemplary useful amphoteric surfactants include alkylbetaines, particularly those which may be represented by the following structural formula:

$$RN(CH_3)_2CH_2COO^-$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

$$RCONHCH_2CH_2CH_2N^+(CH_3)_2CH_2COO^-$$

wherein R is a straight or branched hydrocarbon chain which may include an aryl moiety, but is preferably a straight hydrocarbon chain containing from about 6 to 30 carbon atoms.

Particularly exemplary useful betaines include dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

What is to be understood by the term "concentrate" and "concentrate composition" in this specification and claims is the pre-consumer dilution and composition of the cleaning composition which is the essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surfaces.

It is also to be understood, that proportions of one or more constituents have been and generally are referred to as percent by weight or as parts by weight based on a measure of 100% by weight, unless otherwise indicated.

According to certain particularly preferred embodiments of the invention there are provided aqueous concentrated liquid disinfectant composition which comprise the following constituents:

1–10% wt. of botanical oil constituent;

0.1–35% wt. of an organic solvent constituent;

0.1–12% wt. of an alkyl diphenyl solvent constituent;

1–20% wt. of a botanical oil solubilizing constituent, especially one or more amine oxide surfactants;

1–5% of an alkylpolyoxycarboxylate constituent;

optionally but desirably up to 20% wt. of at least one optional constituent selected from: chelating agents, coloring agent, light stabilizers, fragrances, thickening agents, hydrotropes, pH adjusting agents, pH buffers one or more detersive surfactant constituents including anionic, catinoic non-ionic and amphoteric surfactants, as well as others known the art, with the proviso that the concentrate compositions do not include pine oil.

As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured amounts of the concentrate compositions in water by the consumer or other end user in certain weight ratios of concentrate:water, and optionally, agitating the same to ensure even distribution of the concentrate in the water. As noted, the concentrate may be used without dilution, i.e., in concentrate:water concentrations of 1:0, to extremely dilute dilutions such as 1:10,000. Desirably, the concentrate is diluted in the range of 1:0.1–1:1000, preferably in the range of 1:1–1:500 but most preferably in the range of 1:10–1:100. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the concentrate in water.

In accordance with preferred embodiments of the invention, when a quantity of the concentrate compositions taught herein are added to a larger volume of water, a blooming characteristic is manifested. Such "blooming" may be broadly characterized as the formation of milky, creamy or cloudy appearance which is manifested when a dilutable composition is added to a larger volume or quantity of water. Such "blooming" may be alternately characterized as the reduction of transmitted light through an amount of water by at least 30%, desirably by at least 40%, yet more desirably by at least about 50%, still more by at least 60%, and yet most desirably by at least 75% or more when a dilution of the concentrate composition:water with the weight or volume ratio range of from 1:64–102, especially 1:64 is formed. That such blooming may be attained without the use of pine oils as are commonly found in certain commercially available pine oil containing preparations is very surprising.

As has been noted, concentrate compositions according to preferred embodiments of the invention exhibit a long lasting blooming effect when they are diluted into a larger volume of water, especially when used to form (weight ratio) dilutions with water of concentrate:water of 1:64 at room temperature (20° C., 68° F.). Desirably, such dilutions do not exhibit an increase in light transmittance in accordance with the measurement methods discussed in the Examples below, of more than 50% (based on the initial 'as mixed' value) during its initial three-day interval.

The composition of the present invention, whether as described herein or in a concentrate or super concentrate form, can also be applied to a hard surface by using a wet wipe. The wipe can be of a woven or non-woven nature. Fabric substrates can include non-woven or woven pouches, sponges, in the form of abrasive or non-abrasive cleaning pads. Such fabrics are known commercially in this field and are often referred to as wipes. Such substrates can be resin bonded, hydroentangled, thermally bonded, meltblown, needlepunched, or any combination of the former.

The non-woven fabrics may be a combination of wood pulp fibers and textile length synthetic fibers formed by well known dry-form or wet-lay processes. Synthetic fibers such as Rayon, Nylon, Orlon and polyester as well as blends thereof can be employed.

The wood pulp fibers should comprise about 30 to about 60 percent by weight of the non-woven fabric, preferably about 55 to about 60 percent by weight, the remainder being synthetic fibers. The wood pulp fibers provide for absorbency, abrasion and soil retention whereas the synthetic fibers provide for substrate strength and resiliency.

The substrate of the wipe may also be a film forming material such as a water soluble polymer. Such self-supporting film substrates may be sandwiched between layers of fabric substrates and heat sealed to form a useful substrate. The free-standing films can be extruded utilizing standard equipment to devolatilize the blend. Casting technology can be used to form and dry films or a liquid blend can be saturated into a carrier and then dried in a variety of known methods.

The compositions of the present invention are absorbed onto the wipe to form a saturated wipe. The wipe can then be sealed individually in a pouch which can then be opened when needed or a multitude of wipes can be placed in a container for use on an as needed basis. The container, when closed, sufficiently sealed to prevent evaporation of any components from the compositions.

The concentrate compositions according to the invention, and aqueous dilutions formed therefrom, are particularly useful in the cleaning of hard surfaces. By way of non-limiting example, hard surfaces include surfaces composed of refractory materials such as: glazed and unglazed tile, brick, porcelain, ceramics as well as stone including marble, granite, and other stones surfaces; glass; metals; plastics e.g. polyester, vinyl; fiberglass, FORMICA, CORIAN and other hard surfaces known to the art. Hard surfaces which are to be particularly denoted include those associated with kitchen environments, lavatory environments, especially flooring surfaces and the surfaces of fixtures (doors, cabinets, shelving, and the like) in such environments.

The following examples below illustrate exemplary and among them preferred formulations of the composition according to the instant invention. It is to be understood that these examples are presented by means of illustration only and that further useful formulations fall within the scope of this invention and the claims may be readily produced by one skilled in the art and not deviate from the scope and spirit of the invention.

EXAMPLES

A number of formulations were produced by mixing the constituents outlined in Table 1 by adding the individual constituents into a beaker of deionized water at room temperature which was stirred with a conventional magnetic stirring rod. The order of addition is not critical, but good results are obtained where the surfactants are added to the water prior to Stirring continued until the formulation was homogenous in appearance. It is to be noted that the constituents might be added in any order, but it is preferred that water be the initial constituent provided to a mixing vessel or apparatus as it is the major constituent and addition of the further constituents thereto is convenient. The exact compositions of the example formulations are listed on Table 1, below.

TABLE 1

| | Ex. 1 | Ex. 2 | Ex. 3 | Ex. 9 |
|---|---|---|---|---|
| peppermint oil | 4 | — | — | — |
| lavender oil | — | 4 | — | — |
| bergamot oil | — | — | 4 | — |
| sweet orange oil | — | — | — | 4 |
| isopropyl alcohol | 12 | 12 | 12 | 12 |
| propylene glycol | 20 | 20 | 20 | 20 |
| lauryl alcohol | 1 | 1 | 1 | 1 |
| amine oxide | 14 | 14 | 14 | 14 |
| diphenyl solvent | 2 | 2 | 2 | 2 |
| $Na_2EDTA$ | 0.5 | 0.5 | 0.5 | 0.5 |
| deionized water | to 100% | to 100% | to 100% | to 100% |

The identity of the specific compositions described on Table 1 are listed on Table 2, following.

TABLE 2

| | |
|---|---|
| peppermint oil | (Berje Co., Bloomfield, NJ) |
| lavender oil | (Berje Co., Bloomfield, NJ) |
| bergamot oil | (Berje Co., Bloomfield, NJ) |
| sweet orange oil | (Berje Co., Bloomfield, NJ) |
| isopropyl alcohol | technical grade, 100% wt. (Eastman Chemical Corp.) |
| propylene glycol | technical grade, 100% wt. (Eastman Chemical Corp.) |
| lauryl alcohol | technical grade mixture of 65–75% wt. 1-dodecanol; 22–28% wt. 1-tetradecanol; 4–8% wt. 1-hexadecanol; and 0–0.5% wt. 1-decanol (Henkel Corp.) |
| amine oxide | bis-(2-hydroxyethyl $C_{12}$—$C_{15}$ alkyloxypropyl) amine oxide, as AO-728 Special (50% wt. of ) from Tomah Inc. |
| diphenyl solvent | dilsopropyl diphenyl (100% wt.) as Nusolv ® ABP-103 |

TABLE 2-continued

| | |
|---|---|
| $Na_2EDTA$ | disodium ethylenediaminetetraacetic acid, sold as VERSENE Acid (Dow Chem. Co.) |
| caramel solution (1% wt.) | aqueous caramel solution, 1% wt. caramel, as a coloring agent |
| deionized water | deionized water |

The blooming characteristics of these formulations was characterized by using the Brinkman Sybron PC 801 colorimeter. Each tested formulation were diluted with tap water in a weight ratio of 1:64, and the test was carried out with each of the formulations and water at room temperature (68° F., 20° C.). The resulting determined values, reported as "blooming" in the following table provide an empirical evaluation in percent transmittance (%) of the degree of transparency of a diluted example formulation wherein 0% indicates complete opacity and 100% the transparency of a tap water sample. The results are tabulated on Table 3:

TABLE 3

| | % Transmittance |
|---|---|
| Comp. 1* | 0.8 |
| Ex. 1 | 2.3 |
| Ex. 2 | 1.7 |
| Ex. 3 | 1.2 |
| Ex. 4 | 1.7 |

Comparative 1 (Comp. 1*) was DETTOL (Reckitt & Colman PLC, Hull, UK), a soap based, blooming type disinfecting concentrate composition which does not include diphenyl solvents. DETTOL has a particularly substantive bloom and is used as a 'benchmark' for other formulations.

As may be seen from the results indicated on Table 3, the formulations according to the invention based on the botanical oil constituent provided very satisfactory blooming.

Cleaning Test:

Cleaning efficacy was measured for weight ratios of 1:64 (concentrate composition:water) aqeuous dilutions of formulations according to Examples 1 and 3, and as a control, the formulation according to Comp. 1 described above. The test was carried out using the ASTM D4488-89, Annex A2 method—greasy soil on painted masonite wallboard test, using a Gardner Washability Apparatus.

Latex painted masonite wallboard is soiled with a mixture of melted, oily soils containing a small amount of carbon black and allowed to set overnight. A first aqueous dilution is applied to a sponge that scrubs half the soiled substrate in a straight-line using the Gardner Washability Apparatus. Afterwards, the second aqueous dilution is applied to a further sponge that scrubs the other half of the soiled substrate in a similar manner.

In determining the cleaning efficiency, reflectance values were determined using a Gardner Lab Scan Reflectometer for each of the following: a clean unsoiled panel, a soiled panel, and a soiled panel following Gardner Washability Apparatus scrubbing. Such reflectance values were then employed to calculate % cleaning efficiency according to the following formula:

$$\%\ \text{Cleaning Efficiency} = \frac{Lt - Ls}{Lo - Ls} \times 100\%$$

wherein,

Lt=% reflectance average after scrubbing solid tile

Ls=% reflectance average before cleaning soiled tile

Lo=% reflectance average original tile before soiling.

The cleaning efficacy of each formulation was evaluated on five tiles, and the average results for each set of 5 tiles are reported on Table 4, below.

TABLE 4

| Formulation: water (1:64) w/w dilution | unsoiled reflectance (Lo) | soiled reflectance (Ls) | After scrubbing reflectance (Lt) | % Cleaning Efficiency |
|---|---|---|---|---|
| Comp. 1 | 94.8 | 24.0 | 51.8 | 39.2 |
| Ex. 1 | 94.8 | 24.0 | 48.4 | 34.5 |
| Ex. 3 | 94.8 | 24.0 | 50.3 | 37.1 |

As shown, the measurement of the cleaning effectiveness of the test samples involved the ability of the cleaning composition to remove the test soil from the test substrate. This was expressed by % Cleaning Efficiency. As numerical values for a % Cleaning Efficiency increase, higher cleaning effectiveness is achieved for the cleaning composition tested. As the results show, the inventive compositions showed an excellent cleaning property.

What is claimed is:

1. An aqueous concentrated liquid hard surface cleaning composition which blooms when added to a larger volume of water which comprises the following constituents:

botanical oil constituent;

at least one botanical oil solubilizing surfactant;

an alkyl diphenyl solvent;

a binary solvent system which includes at least one organic alcohol constituent and at least one glycol solvent constituent;

optionally, a polyoxycarboxylate constituent;

optionally, a chelating agent which includes at least one non-ionized acetate group, optionally, at least one optional constituent selected from: further chelating agents, coloring agents, light stabilizers, fragrances, thickening agents, hydrotropes, pH adjusting agents, pH buffers one or more detersive surfactant constituents, and, water.

2. The composition according to claim I wherein the botanical oil constituent is selected from: peppermint oil, lavender oil, bergamot oil, rosemary oil, and sweet orange oil.

3. The composition according to claim 1 wherein the botanical oil solubilizing surfactant is an amine oxide surfactant.

4. The composition according to claim 3 wherein the amine oxide surfactant is selected from those according to the formulae:

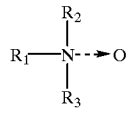

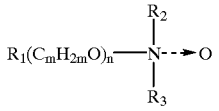

wherein:

$R_1$ is hydrogen or is an alkyl, 2-hydroxyalkyl, 3-hydroxyalkyl, or 3-alkoxy-2-hydroxypropyl radical where the alkyl and alkoxy parts contain from about 8 to about 18 carbon atoms;

$R_2$ and $R_3$ are independently selected from methyl, ethyl, propyl, isopropyl, 2-hydroxyethyl, 2-hydroxypropyl, or 3-hydroxypropyl;

m is an integer from 2 to 4; and n is an integer from 0 to about 10.

5. The composition according to claim 4 wherein the amine oxide constituent is represented by the formula:

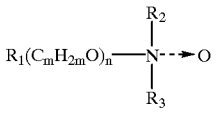

wherein, $R_1$ is an alkyl radical of from 12 to 16 carbon atoms, $R_2$ and $R_3$ are independently selected from methyl or ethyl, m is 2, and n is 0.

6. The composition according to claim 1 wherein the alkyl diphenyl solvent is represented according to the structure:

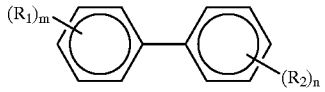

wherein:

$R_1$ is hydrogen or is a lower alkyl radical, containing 1 to 10 carbon atoms which may be straight chained or branched, $R_2$ is a lower alkyl radical, preferably a $C_1$–$C_{10}$, containing 1 to 10 carbon atoms which may be straight chained or branched, m is an integer from 1–3 inclusive; and, n is an integer from 1–3 inclusive.

7. The composition according to claim 6 wherein:

$R_1$ is hydrogen, m is 1, n is an integer from 1–3 inclusive, and, $R_2$ is a C114 C6 straight chained or branched alkyl radical.

8. The composition according to claim 1 wherein the organic alcohol constituent includes isopropyl alcohol.

9. The composition according to claim 1 wherein the organic alcohol constituent includes lauryl alcohol.

10. A composition according to claim 1 wherein the binary solvent system includes propylene glycol.

11. The composition according to claim 1 wherein the organic alcohol constituent includes isopropyl alcohol and lauryl alcohol, and the glycol solvent constituent includes propylene glycol.

12. The composition according to claim 1 which includes a carboxylate constituent.

13. The composition according to claim 12 wherein the carboxylate constituent is selected from alkylcarboxylates, alkylarylcarboxylates, alkylpolyoxycarboxylates and polyethoxycarboxylates.

14. The composition according to claim 1 which includes a mono-, di- or tri- alkali or alkaline ethylenediaminetetraacetic acid.

15. The composition according to claim 1 which does not include any significant proportion pine oil.

16. The composition according to claim 15 which includes less than 0.1% wt. of pine oil.

17. The aqueous dilution of the composition according to claim 1 in a larger volume of water.

18. The aqueous dilution of the composition according to claim 17 characterized in that the resultant dilution exhibits a reduction of transmitted light of at least 30%, when a dilution of the concentrate composition:water with the weight or volume ratio range of from 1:64 is formed.

19. A process for cleaning a hard surface which comprises the step of:

applying a cleaning effective amount composition according to claim 1 to a hard surface.

20. The composition according to claim 6 wherein the alkyl diphenyl solvent is represented according to the structure:

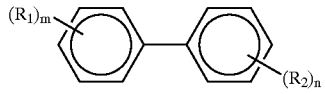

wherein:

$R_1$ is hydrogen or is a lower alkyl radical containing 1 to 6 carbon atoms which may be straight chained or branched, $R_2$ is a lower alkyl radical containing 1 to 6 carbon atoms which may be straight chained or branched, m is an integer from 1–3 inclusive; and, n is an integer from 1–3 inclusive.

* * * * *

UNITED STATES PATENT AND TRADEMARK OFFICE
CERTIFICATE OF CORRECTION

PATENT NO. : 6,177,388

DATED : JANUARY 23, 2001

INVENTOR(S) : DENNIS THOMAS SMIALOWICZ AND TAK WAI CHEUNG

It is certified that error appears in the above-identified patent and that said Letters Patent is hereby corrected as shown below:

In claim 1, line 40, after "pH buffers" insert --,--.

In claim 7, line 44, delete "C114 C6" and insert --$C_1$-$C_6$--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*